United States Patent [19]

Baldyga

[11] Patent Number: 4,654,952

[45] Date of Patent: Apr. 7, 1987

[54] WIRE LOCATER FOR ELECTRICAL TERMINAL CRIMPING APPARATUS

[75] Inventor: Joseph Baldyga, Islamorada, Fla.

[73] Assignee: Diamond Die & Mold Co., Mt. Clemens, Mich.

[21] Appl. No.: 883,775

[22] Filed: Jul. 9, 1986

[51] Int. Cl.[4] ..... H01R 43/04

[52] U.S. Cl. ..... 29/566.2; 29/753; 72/338; 72/410

[58] Field of Search ..... 29/566.2, 566.3, 753, 29/857, 861, 862, 863, 748, 749, 33 M, 564.1, 564.6, 564.7; 72/338, 339, 332, 461, 410

[56] References Cited

U.S. PATENT DOCUMENTS

| | | | |
|---|---|---|---|
| 2,951,409 | 9/1960 | Berg | 83/228 |
| 3,253,451 | 5/1966 | Kerns et al. | 72/331 |
| 3,310,973 | 3/1967 | Leis | 72/420 |
| 3,420,086 | 1/1969 | Long et al. | 72/338 |
| 3,484,922 | 12/1969 | Fritz et al. | 29/753 |
| 3,588,984 | 8/1969 | Van De Kerkof | 29/753 |
| 3,710,610 | 1/1973 | McCaughey | 72/410 |
| 3,795,962 | 3/1974 | Baldyga | 29/203 D |
| 3,848,316 | 11/1974 | Bakermans et al. | 29/566.2 |
| 3,867,754 | 2/1975 | Koch et al. | 29/566.2 |
| 3,977,587 | 8/1976 | Baldyga et al. | 226/74 |
| 4,216,668 | 8/1980 | Walton, II | 72/412 |
| 4,244,101 | 1/1981 | Talley | 29/753 |
| 4,247,980 | 2/1981 | Tominoi | 29/753 |
| 4,283,846 | 8/1981 | Collier | 29/566.2 X |
| 4,307,504 | 12/1981 | Davis et al. | 29/566.3 |
| 4,335,497 | 6/1982 | Casey | 29/566.2 |
| 4,598,570 | 7/1986 | Baldyga | 29/566.2 |

FOREIGN PATENT DOCUMENTS

| | | | |
|---|---|---|---|
| 667285 | 6/1979 | U.S.S.R. | 72/332 |

*Primary Examiner*—William R. Briggs

*Attorney, Agent, or Firm*—Basile, Weintraub & Hanlon

[57] ABSTRACT

A crimping die apparatus for crimping an electric terminal upon the end of an electrical conductor and severing the terminal from a carrier strip during the crimping operation by means of a cutter driven in its severing action by crimping action of the die is provided with conductor or wire locating fingers opened and closed by motion of the die. The fingers are operable to grip the conductor closely adjacent the plane of action of the cutter and actuation of the cutter is accomplished by the fingers as the fingers align the conductor with the terminal which is to be crimped about the conductor.

8 Claims, 13 Drawing Figures

90a
92
110
108
104
94
106
112

100
102
98
96

114

44
48
52
50
90b
88
74
76
78
84
68
66
60
64
70
80
72
82
86
56
58
61

WIRE LOCATER FOR ELECTRICAL TERMINAL CRIMPING APPARATUS

BACKGROUND OF THE INVENTION

The present invention concerns a wire locater for use in electrical terminal crimping apparatus of the type in which an electric terminal of generally U-shaped transverse cross section is positioned upon a stationary anvil, an electric conductor is located within the U-shaped terminal, and a crimping die cooperable with the anvil is driven downwardly to fold the upstanding leg portions of the U-shaped portion of the terminal tightly around the conductor to mechanically crimp the terminal into assembled relationship on the end of the conductor. The wire locater of the present invention, while adaptable to other crimping apparatus, is especially designed for use in a crimping apparatus such as that disclosed in my co-pending application Ser. No. 06/690,256, filed Jan. 10, 1985, now U.S. Pat. No. 4,598,570.

In the apparatus disclosed in my aforementioned application, electric terminals to be crimped are fed in step-by-step movement to the apparatus integrally attached at one end to an elongate carrier strip, each step of movement of the carrier strip advancing a terminal into position upon a stationary anvil of the crimping apparatus. The anvil is formed with a flat front surface lying in a general vertical plane and a vertically movable cutter element slides in face-to-face engagement with the front surface of the anvil. The face of the cutter engaged with the anvil is formed with a horizontal slot which slidably receives the carrier strip to properly locate the terminal relative to the anvil and, in a normally maintained rest position, to guide the terminal onto the upper surface of the anvil. A vertically movable die assembly is mounted above the anvil and a terminal is advanced to the anvil by driving the carrier strip forwardly while the die assembly is in a raised position. When the terminal is located on the anvil, a wire is moved into alignment with the terminal and the die assembly is driven downwardly to perform the crimping operation. During this downward movement of the die assembly, the die assembly engages the cutter and drives the cutter downwardly. The carrier strip is trapped within the horizontal slot in the cutter, and upon downward movement of the cutter the terminal on the anvil is sheared from the carrier strip along the plane of engagement between the cutter and the vertical front face of the anvil. The die assembly is then raised and the cycle is repeated.

In order to produce a satisfactory mechanical and electrical connection between the wire and the terminal, the wire end which is to be crimped to the terminal must be moved into vertical alignment with the U-shaped portion of the terminal so that the wire is centered between the opposed legs of the U-shaped section immediately prior to the crimping of the legs onto the wire. Various wire locating devices for performing this function are known in the prior art. In general, many of the prior art devices have been found satisfactory for use with larger wire sizes where the wire and its insulation are reasonably rigid. However, the trend toward miniaturization of electric circuitry and circuit elements has resulted in the usage of increasingly smaller terminals and relatively small or fine wires. The reduction in size of the terminal itself increases the degree of precision required to accurately align the wire and terminal, while at the same time the finer wires employed with the smaller terminals are very flexible and easily bent.

With the smaller terminals, feeding of the terminals by means of a carrier strip as described above is almost the universal practice and usage of the carrier strip feeding method requires that the terminal be sheared from the carrier strip as it is crimped upon the wire. Because feeding the wire into position with respect to the terminal finds the wire passing across the top of the cutter, prior art wire locaters have been located at the side of the cutter remote from the terminal. Because a portion of the vertically movable die assembly conventionally engages the top of the cutter to drive it downwardly in shearing movement, apparatus for locating the wire relative to the terminal must be clear of the path of movement of the die assembly and thus, of necessity, spaced some distance (one-half inch or more) from the terminal. Where the wire is sufficiently rigid, this spacing does not pose any great problem; but when extremely fine wire is used, the end of the wire beyond the locater may be bent within this spacing to a degree where it may entirely miss the terminal.

The present invention is directed to the provision of a wire locater assembly for use in crimping apparatus of the type referred to above in which the wire may be gripped by the locater closely adjacent the front vertical surface of the anvil so that the only portion of the wire not supported by the locater is that which vertically overlies the terminal.

SUMMARY OF THE INVENTION

Conventional elements of a crimping die apparatus with which the present invention is employed include a stationary anvil having a flat front surface extending parallel to the direction in which the terminal carrier strip is fed to the apparatus. A vertically movable cutter is disposed in sliding face-to-face relationship with the front surface of the anvil and is normally biased to a ready position in which the carrier strip is received within the cutter slot to support the terminals on the strip at an elevation such that the terminal to be crimped rests upon the top of the stationary anvil. Downward movement of the cutter shears the strip from a terminal on the anvil as the cutter is slid vertically downwardly along the front surface of the anvil.

Mounted above the anvil is a vertically movable die assembly which carries crimping dies vertically aligned with the anvil. The dies are movable from a ready position spaced vertically above the anvil to a crimping position wherein the dies crimp a terminal supported upon the anvil about a conductor previously positioned within the terminal.

In accordance with the present invention, a locater finger actuator member is fixedly mounted on the die assembly immediately in front of the die generally in vertical alignment with the cutter. A stationary bracket is spaced in front of the actuator member and carries a vertically movable slide block which is normally spring biased upwardly relative to the bracket to a rest position determined by the engagement between a pin on the slide block and the top of a vertical slot in the bracket. On the face of the slide block facing the finger actuator member, a pair of opposed wire engaging fingers are mounted for pivotal movement about spaced horizontal axes. Actuator pins projecting forwardly from the stationary actuator member are engageable with the fingers to pivot the fingers between an open position wherein a wire may be advanced between the opened fingers and a closed position in which the fingers clampingly grip a wire between the two fingers. The lower wire gripping portion of the fingers is offset from the pivotally mounted upper portion of each finger to project beneath the actuator member to be vertically aligned with the top of the cutter on the stationary anvil when the fingers are in their closed position. Downward movement of the vertically movable die assembly causes the actuator member to close the fingers to grip the wire between the fingers and to drive the closed fingers downwardly into engagement with the top of the cutter, this downward movement of the fingers being resisted by the upwardly spring biased slide block on the bracket. Downward movement of the fingers is employed to actuate the cutter as the dies on the die assembly move into operative relationship with a terminal located on the anvil, the downwardly moving fingers carrying the wire into position upon the terminal immediately prior to the crimping of the terminal.

The lower portions of the fingers move in a path closely adjacent the front surface of the anvil; hence, the wire is held at a location substantially at the front end of the terminal to insure an accurate location of the wire relative to the terminal.

Other objects and features of the invention will become apparent by reference to the following specification and to the drawings.

IN THE DRAWINGS

DETAILED DESCRIPTION OF THE PREFERRED EMBODIMENTS

Figure 1:
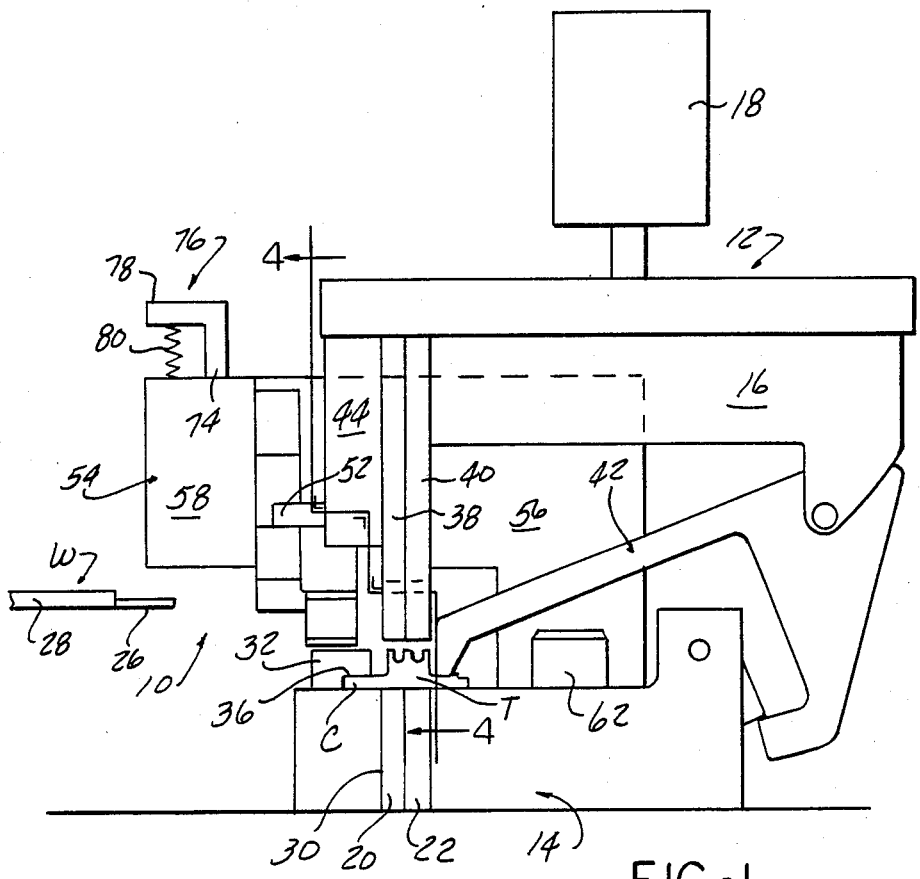
FIG. 1 is a side elevational view of a crimping die assembly including a wire locater embodying the present invention, with certain parts omitted.
Figure 2:
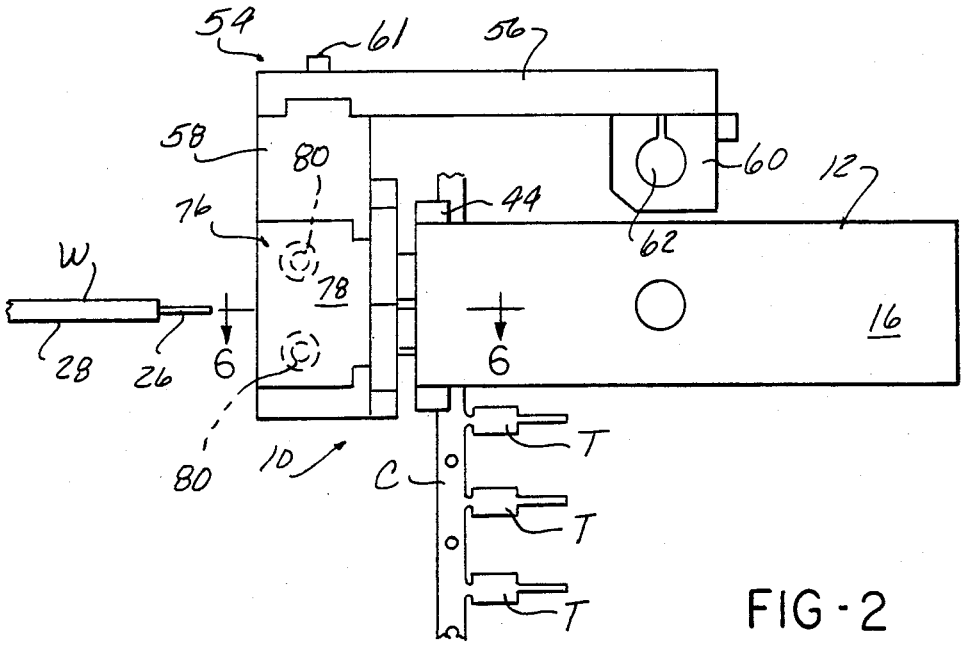
FIG. 2 is a top plan view of the apparatus of FIG. 1, again with certain parts omitted.

Referring first to FIGS. 1 and 2, the wire locater assembly of the present invention designated generally 10 is disclosed mounted upon a die apparatus designated generally 12 of the type disclosed in my aforementioned application Ser. No. 06/690,256. Die apparatus 12 includes a stationary anvil-cutter assembly designated generally 14 and a vertically movable die assembly 16 driven in vertical recriprocation as by a fluid motor schematically illustrated at 18. Die assembly 16 is guided in vertical movement by suitable means, not shown, and the cylinder of motor 18 is mounted upon a stationary frame member, again not shown.

Figure 6:
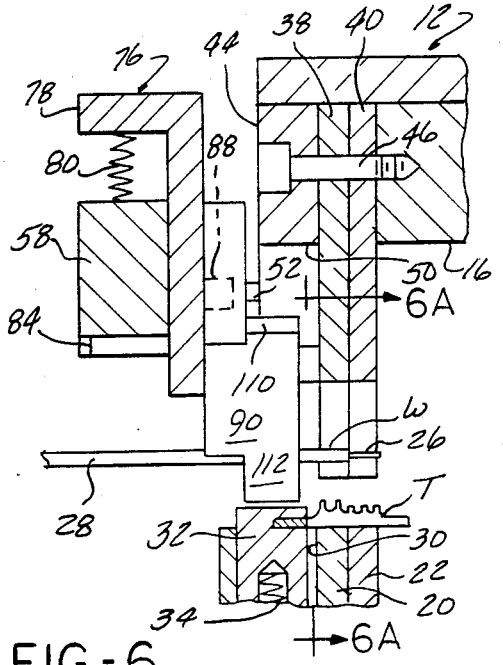
FIG. 6 is a detailed cross-sectional view taken on the line 6—6 of FIG. 2, showing the wire locater and front portion of the die assembly with the die assembly in the elevated position of FIG. 1.
Figure 7:
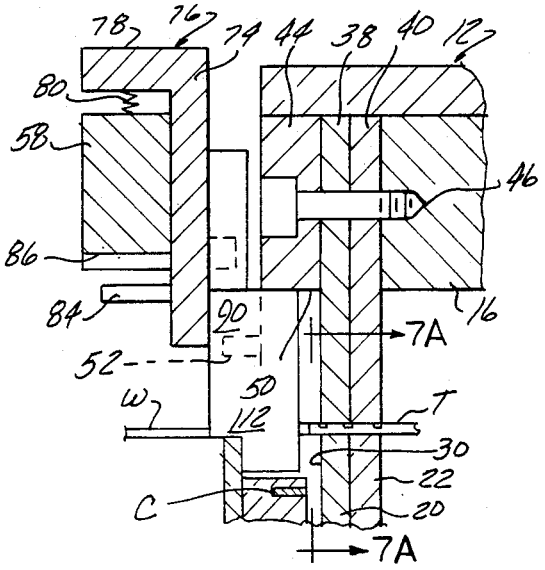
FIG. 7 is a detailed cross-sectional view similar to FIG. 6 but showing the die assembly in its lowered crimping position.
Figure 6A:
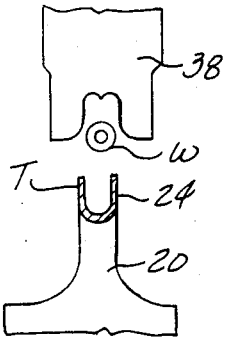
FIG. 6A is a partial detailed cross-sectional view taken on the line 6A—6A of FIG. 6.
Figure 7A:
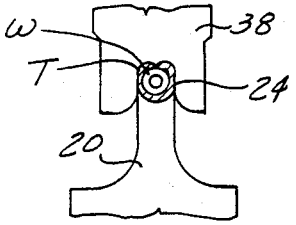
FIG. 7A is a partial detailed cross-sectional view taken on the line 7A—7A of FIG. 7.

Anvil assembly 14 includes a pair of plate-like anvils 20, 22 which, as best seen FIGS. 6A and 7A, are formed at their top with terminal receiving seats as at 24 (FIGS. 6A, 7A) which underlie and support an electric terminal T during the crimping operation. Two anvils 20 and 22 are shown because typically one portion of the terminal will be crimped about the stripped end portion 26 of a wire W while another portion of the terminal will be crimped about an insulated portion of the wire 28 closely adjacent the stripped end 26. The supporting seats 24 of anvils 20, 22 will be shaped accordingly.

The front surface 30 of the front anvil 20 is a flat, vertically disposed surface and, as best seen in FIGS. 6 and 7, a cutter 32 is mounted in vertical sliding face-to-face engagement with front surface 30. A spring 34 normally biases cutter 32 to an elevated position in which a slot 36 extending horizontally across the rear face of the cutter is located at the same elevation as seats 24 of anvils 20 and 22.

As best seen in FIG. 2, the terminals T are fed into the die apparatus by means of a carrier strip C to which the terminals are attached at uniformly spaced intervals. Means for feeding carrier strips C to the die apparatus are well known in the art. The carrier strip C is slidably guided by the slot 36 in cutter 32 when the cutter is at its normal elevated position shown in FIG. 1 and the carrier strip feed means, not shown, advances the carrier strip in step-by-step movement synchronized with the operation of the die apparatus to advance the individual terminals T onto anvils 20 and 22.

A pair of crimping dies 38, 40 are fixedly mounted on the vertically movable die carrier 16 in respective vertical alignment with anvils 20 and 22. As best seen in FIGS. 6A and 7A, the dies 38, 40 are movable by the die carrier 16 between an elevated ready position shown in FIG. 6A and a lowered crimping position shown in FIG. 7A and are so conformed as to crimp the upwardly projecting legs of the U-shaped cross-sectional portion of terminal T around the wire W as shown in FIG. 7A. A holddown-stripper finger designated generally 42 may be carried by die carrier 16 to assist in steadying the terminal during the crimping operation and stripping the crimped terminal from dies 38, 40 as the die are elevated back to their ready position subsequent to the crimping of the terminal.

The structure described thus far is disclosed and described in greater detail in my aforementioned co-pending application Ser. No. 06/690,256 and does not, per se, constitute the present invention. The present invention is concerned with details of the apparatus 10 for locating the wire W in vertical alignment with a terminal upon the anvil to accurately position the wire relative to the terminal immediately prior to the crimping operation.

Figures 3, 8, 9, 10, 11:
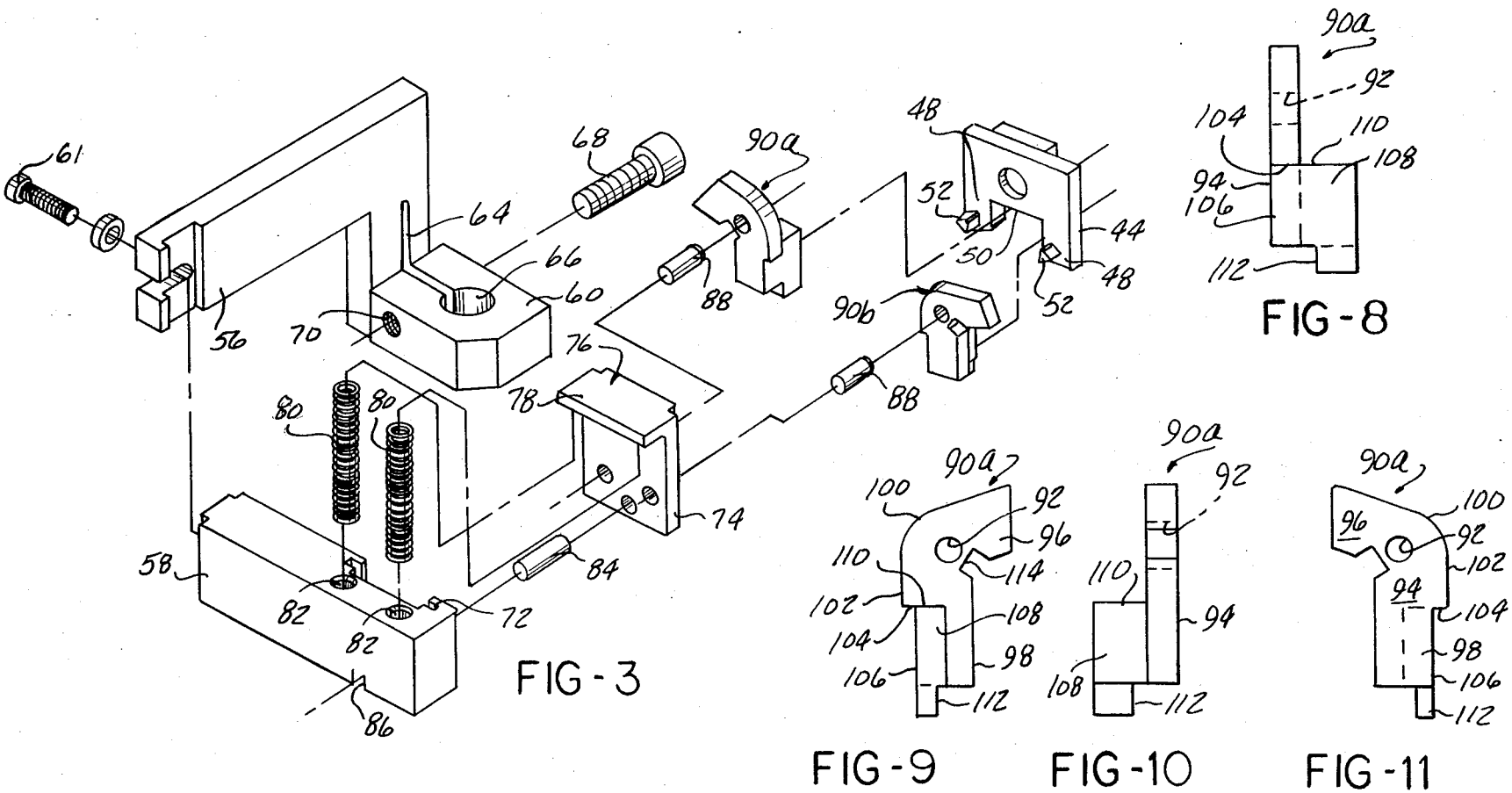
FIG. 3 is an exploded perspective view showing the individual structural elements of the wire locater assembly of FIG. 1.
FIG. 8 is an inner side view of one of the locater fingers.
FIG. 9 is a rear view of the finger of FIG. 8.
FIG. 10 is an outer side view of the finger of FIG. 8.
FIG. 11 is a front view of the finger of FIG. 8.

The structural components of wire locater apparatus 10 are shown, per se, in the exploded perspective view of FIG. 3.

The wire locater apparatus 10, referring now particularly to FIGS. 3, 6 and 7, includes an actuator member 44 which, as best seen in FIGS. 6 and 7, is fixedly mounted at the front end of die carrier 16 as by a bolt 46 which is also employed to mount dies 38 and 40 upon carrier 16. Actuator 44 is thus fixedly secured to die carrier 16 and moves upwardly and downwardly with the carrier during the crimping and return stroke of dies 38 and 40. As best seen in FIG. 3, actuator 44 is formed with a pair of spaced, opposed, downwardly projecting legs 48 which project downwardly from a horizontal, centrally located lower edge surface 50 on the actuator. Near the lower end of each of legs 48, actuating lugs 52 of generally triangular cross section project forwardly from the front surface of actuator 44.

A mounting bracket assembly designated generally 54 (FIGS. 1 and 2) includes a pedestal member 56 and a slide block carrying arm 58 which is fixedly secured, as by a bolt 61, to project from pedestal 56 laterally of the die apparatus in forwardly spaced relationship to actuator member 44. Pedestal 56 is fixedly mounted upon the machine frame by clamping the foot portion 60 of pedestal 56 upon a guide pin 62 (FIGS. 1 and 2) mounted at a fixed location on the frame. Pedestal 56 is slotted as at 64, with the slot intersecting a guide pin receiving bore 66 through foot 60, and a clamping screw 68 which passes through the slot is tightened into a threaded bore 70 to firmly clamp the pedestal to pin 62.

Referring now particularly to FIG. 3, a vertically extending T slot 72 is formed in that face of arm 58 opposed to actuator member 44 to slidably receive a vertical plate portion 74 of a slide block designated generally 76. At the upper end of vertical plate portion 74 of slide block 76, an integral horizontal web 78 projects into overlying relationship with arm 58 when the slide block is received within slot 72 in the arm. A pair of compression springs 80 have their lower ends seated within bores 82 in arm 58 and engage the underside of horizontal web 78 to continuously bias slide block 76 upwardly relative to arm 58. The upper end limit of movement of slide block 76 relative to arm 58 is determined by the engagement of a pin 84, fixedly secured to the lower end of vertical leg portion 74 of the slide block, with the upper end of a slot 86 extending upwardly from the lower surface of arm 58.

A pair of pivot pins 88 project horizontally from the side of vertical plate portion 74 of slide block 76 facing actuator 44. Pivot pins 88 pivotally support a pair of wire locater fingers designated generally **90*a* and 90*b*** which are identical with each other, with the exception of being right and left-handed or mirror images of each other.

In FIG. 3, the front direction is indicated by arrow, and FIGS. 8, 9, 10 and 11 show the four sides of finger **90*a***.

Figure 4:
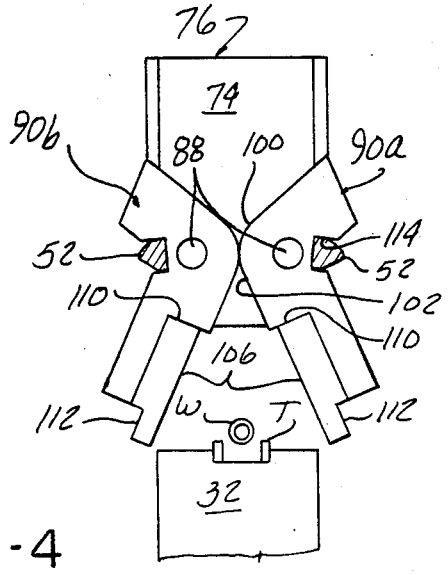
FIG. 4 is a detailed view, with certain parts omitted, taken approximately on the line 4—4 of FIG. 1, showing the fingers of the wire locater in their open position.
Figure 5:
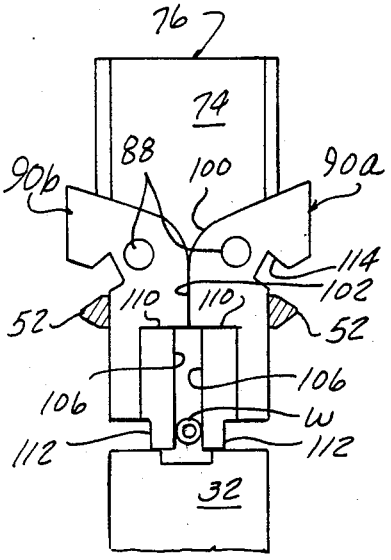
FIG. 5 is a view similar to FIG. 4, showing the wire locater fingers in their closed position.

Referring now to FIGS. 8 through 11, finger **90*a* is formed with a bore 92 which rotatively receives its associated pivot pin 88. The finger is formed with a flat front surface 94 which slidably engages the flat opposed surface of slide block 76. The finger is formed with upper 96 and lower 98 arm portions, each of which extends generally radially from the axis of bore 92 as best seen in FIGS. 9 and 11. As best seen in FIGS. 4 and 5, when the fingers 90*a* and 90*b* are mounted on pivot pins 88 of slide block 76, the fingers are in an opposed relationship to each other such that opposed edges of the respective fingers contact each other along a curved edge section 100 when the fingers are in the open position of FIG. 4, the curved edge section 100 being concentric about the axis of bore 92. When the fingers are in the closed position of FIG. 5, the fingers contact each other along a section 102 of the edge of the lower arm which extends downwardly in tangential relationship to curved section 100 to a downwardly facing shoulder 104 on lower arm 98. That portion of the edge section 106 which extends downwardly from shoulder 104 is offset inwardly of the finger from edge section 102 by a distance which is equal to one-half of the diameter of the wire which is to be gripped by the fingers, as in FIG. 5. Returning now to FIGS. 8 through 11, finger 90*a* includes a rearwardly offset or thickened gripping portion 108 having a flat upper surface 110, and a downwardly projecting extension 112. A slot 114 extends radially of bore 92 at the included angle side of the juncture of upper and lower arms 96 and 98**.

The foregoing description of the finger **90*a* is equally applicable to finger 90*b* with the exception that finger 90*b* is constructed as a mirror image of finger 90*a***.

Referring now to FIGS. 4 and 5, the lugs 52 on actuator 44 are employed to shift the fingers between the open position of FIG. 4 and the closed position of FIG. 5 in accordance with the vertical position of actuator 44 relative to slide block 76. When die carrier 16 is in its elevated ready position (FIGS. 1 and 6) slide block 76 is in its elevated position relative to arm 58. At this time, the lugs 52, as best seen in FIG. 4, are at substantially the same elevation as pivot pins 88 on slide block 76 and are seated within the respective slots 114 of the fingers. This positions the fingers in the open position as shown in FIG. 4. With the fingers in their opened position, a wire W may be advanced between the fingers, moving in a direction from left to right as viewed in FIG. 1 until the wire is appropriately located in the front-to-rear direction relative to terminal T.

As the die carrier 16 begins to move downwardly in the initial portion of its crimping stroke, actuator 44 must move with the die carrier and the lugs 52 on the die carrier thus begin to move downwardly below the axes of pivot pins 88 as viewed in FIGS. 4 and 5. The engagement between the lowering lugs 52 and the bottom of slots 114 as viewed in FIG. 1 causes the respective fingers to pivot inwardly from the position shown in FIG. 4 toward that shown in FIG. 5. Eventually, the fingers are pivoted to the position shown in FIG. 5, at which time the lugs 52 pass out of their respective slots 114 to slide downwardly along the outer side of the lower arms of the respective fingers **90*a* and 90*b*. In FIG. 5, the lugs 52 are shown just after they have been moved downwardly out of slots 114, this action occurring at the beginning of the downward stroke of die carrier 16. Fingers 90*a* and 90*b* are now in their closed position and the wire W is gripped between the opposed lower edge sections 106 of the legs. Movement of the fingers to their closed position shown in FIG. 5 has also swung the extensions 112, at the lower ends of the fingers, into overlying relationship with the upper end of cutter 32. The wire at this time is lightly gripped between the opposed lower arms of fingers 90*a* and 90*b*** and is, at this particular time, still spaced above the terminal T located on the anvil.

Further downward movement of die carrier 16 moves actuator 44 downwardly until the lower edge surface 50 engages the upper surfaces 110 of the rearwardly offset lower portions of the respective fingers.

Subsequent to the engagement between surface 50 on actuator 44 and surfaces 110 of the fingers, further downward movement of die carrier 16 and actuator 44 drives the fingers and slide block 76 downwardly relative to carrier arm 58 against the action of spring 80. This downward movement of the fingers in turn drives extensions 112 downwardly, driving cutter 32 downwardly to shear the terminal T from its carrier strip C. The downward stroke is continued until the terminal is crimped, the parts being in the position shown in FIG. 7 at this time. Upon conclusion of the crimping, die carrier 16 is elevated and returned to its original rest position, the lugs 52 on the elevating actuator 44 sliding upwardly along the outer sides of the lower arms of the fingers until they again enter slots 114 and moving upwardly until they engage the top portions of the respective slots 114 shortly prior to reaching the upper rest position to swing the fingers back to the open position shown in FIG. 4.

While one embodiment of the invention has been described in detail, it will be apparent to those skilled in the art that the disclosed embodiment may be modified. Therefore, the foregoing description is to be considered exemplary rather than limiting, and the true scope of the invention is that defined in the following claims.

I claim:

1. In an apparatus for crimping generally U-shaped transverse cross-sectional portions of an electric terminal tightly around an electric conductor at a crimping station wherein said terminals are fed to said crimping station integrally attached to an elongate carrier strip and severed from said strip during the crimping of the terminal, said apparatus including stationary anvil means having a flat vertical front surface and a terminal seat at the top of said anvil means extending rearwardly from said front surface crimping die means mounted above said anvil means for vertical movement between an elevated ready position spaced above said anvil and a lowered crimping position adjacent said anvil, said die means being operable upon downward movement to said crimping position to crimp the U-shaped portion of a terminal supported on said terminal seat, and cutter means mounted for vertical sliding movement against said front surface of said anvil means between an elevated normal position and a lowered actuated position, said cutter means being operable during downward movement from said normal position to said actuated position to sever a terminal supported on said terminal seat from said carrier strip;

the improvement comprising wire locating means including a fixed frame spaced above and in front of said cutter means and said anvil, a slide block mounted in said frame at the rearward side thereof for vertical movement between an elevated rest position and a lowered locating position, spring means biasing said block to said rest position, a pair of opposed locating fingers mounted on the rearward side of said block for pivotal movement in a general plane parallel to said front surface of said anvil between an open position and a closed position, finger actuating means mounted on the front of said die means and operable to locate said fingers in said open position when said die means is in its ready position and to locate said fingers in said closed position when said die means is below said ready position and to drive said fingers and said slide block downwardly against the action of said spring means as said die means moves downwardly from said ready position, said fingers when in said closed position being operable to grip an electric conductor between the lower portions of said fingers and to vertically align the conductor with the U-shaped portions of a terminal on said terminal seat and to carry the gripped conductor downwardly onto said terminal as said die means moves downwardly toward said crimping position, said fingers further including rearwardly offset, downwardly projecting extensions located in vertical alignment with said cutter means when said fingers are in their closed position and operable upon downward movement of said fingers to drive said cutter means to its actuated position.

2. The invention defined in claim 1 wherein said finger actuating means comprises a plate fixedly mounted on the front end of said die means, a pair of horizontally spaced lugs fixedly mounted on said plate and projecting forwardly from said plate to engage said fingers between said lugs, and cooperating cam surface means on said lugs and said fingers for driving said fingers between their open and closed positions in response to relative vertical movement between said actuating means and said fingers.

3. The invention defined in claim 2 wherein said fingers each comprise a lower arm portion having parallel inner and outer side edge sections extending downwardly from the axis of pivotal movement of the finger, the side edge sections of said lower arms extending vertically when said fingers are in their closed position, said lugs on said actuating means being horizontally spaced from each other by a distance substantially equal to the distance between the outer side edge sections of the respective fingers when the fingers are in their closed position, means at the upper end of each outer edge section defining a cam means defining a slot extending radially inwardly toward the pivot axis of the finger, each slot having an upper edge projecting outwardly beyond said outer edge section into overlying relationship to the associated lug.

4. The invention of claim 3 wherein said plate of said actuator is vertically aligned with said cutter means, said rearwardly offset extensions of said fingers being located on said lower arm portions of said fingers in underlying relationship with said plate.

5. The invention defined in claim 1 further comprising a pair of pivot pins fixedly mounted on said slide block and projecting rearwardly from said block to define spaced parallel horizontal pivot axes, said fingers each having a pivot pin receiving bore therethrough mounting the fingers upon said pins for movement about the respective pivot axis, said fingers having opposed engaged inner side edges each including a curved edge section concentric with the axis of the bore and a first straight edge section extending tangentially downwardly from the curved edge section, the first straight edge sections of the fingers being in flat edge-to-edge contact with each other when said fingers are in said closed position, and second straight edge sections on said opposed engaged side edges extending downwardly from said first straight edge sections in parallel offset relationship thereto such that said second edge sections are spaced from each other by a distance equal to the diameter of said electric conductor when said fingers are in their closed position.

6. The invention defined in claim 5 wherein each of said fingers includes a lower arm portion extending generally radially downwardly from its bore and an integral upper arm portion extending generally radially in an upwardly and outwardly inclined direction from its bore, said first and second straight edge sections defining the inner side edge of said lower arm portion, an outer side edge on said lower arm portion extending parallel to said first and second straight edge sections, said actuating means comprising a pair of forwardly projecting lugs horizontally spaced from each other to respectively slidably engage the outer side edges of said fingers when said fingers are in their closed position.

7. The invention defined in claim 6 further comprising means on each finger defining a slot extending radially inwardly toward said bore from the upper end of said outer side edge of said lower arm portion, said slot being adapted to receive the associated lug when said die means is in its elevated ready position and said lug being operable when so received to locate the associated finger in its open position.

8. The invention defined in claim 7 wherein said actuating means comprises a plate having a horizontal downwardly facing edge between said lugs in vertical alignment with said cutter means, a rearwardly offset portion projecting from the lower arm portion of each of said fingers into underlying relationship to said edge of said plate, said offset portions having flat upper surfaces oriented to be located in a common horizontal general plane when said fingers are in their closed position, downward movement of said die means from said ready position being operable to drive said edge of said plate into engagement with said flat upper surfaces of said offset portions of said fingers to drive said fingers and said slide block downwardly as said die means moves toward said crimping position, and means at the lower ends of said fingers for driving said cutter means downwardly from its normal position to its actuated position as said die means moves to its crimping position.

* * * * *

UNITED STATES PATENT AND TRADEMARK OFFICE

CERTIFICATE OF CORRECTION

PATENT NO. : 4,654,952

DATED : April 7, 1987

INVENTOR(S) : Joseph Baldyga

It is certified that error appears in the above-identified patent and that said Letters Patent is hereby corrected as shown below:

Column 6, line 35, delete "die carrier" and insert --actuator--.

In The Drawings,

Sheet 2, Fig. 3, the arrow has been added to indicate the front direction of fingers 90a and 90b as per attached sheet.

Signed and Sealed this

Twenty-second Day of September, 1987

*Attest:*

DONALD J. QUIGG

*Attesting Officer* *Commissioner of Patents and Trademarks*

UNITED STATES PATENT OFFICE

CERTIFICATE OF CORRECTION

Patent No. 4,654,952 Dated April 7, 1987

Inventor(s) Joseph Baldyga

It is certified that error appears in the above-identified patent and that said Letters Patent are hereby corrected as shown below:

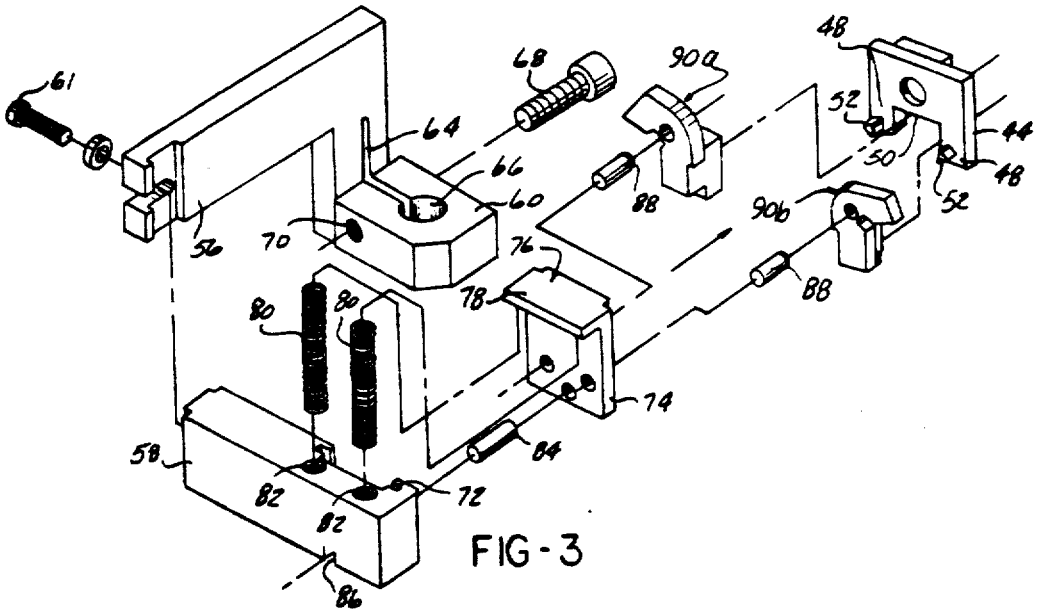

FIG-3